US007806177B2

(12) United States Patent
Bishop et al.

(10) Patent No.: US 7,806,177 B2
(45) Date of Patent: Oct. 5, 2010

(54) RETRACTABLE DOWNHOLE BACKUP ASSEMBLY FOR CIRCUMFERENTIAL SEAL SUPPORT

(75) Inventors: David Bishop, Houston, TX (US); Marc Samuelson, Houston, TX (US); Dennis E. Kroll, League City, TX (US)

(73) Assignee: Baker Hughes Incorporated, Houston, TX (US)

( * ) Notice: Subject to any disclaimer, the term of this patent is extended or adjusted under 35 U.S.C. 154(b) by 0 days.

(21) Appl. No.: 12/361,352

(22) Filed: Jan. 28, 2009

(65) Prior Publication Data

US 2010/0186947 A1 Jul. 29, 2010

(51) Int. Cl.
*E21B 33/128* (2006.01)

(52) U.S. Cl. ..... 166/134

(58) Field of Classification Search ..... 166/387, 166/118, 134, 191

See application file for complete search history.

(56) References Cited

U.S. PATENT DOCUMENTS 2,715,441 A * 8/1955 Bouvier ..... 166/127
4,311,196 A * 1/1982 Beall et al. ..... 166/134
5,487,427 A 1/1996 Curington
5,542,473 A * 8/1996 Pringle ..... 166/120
7,222,669 B2 5/2007 Sonnier et al.
7,290,603 B2 11/2007 Hiorth et al.
7,614,449 B2 11/2009 Anderson
2003/0188862 A1 * 10/2003 Streich et al. ..... 166/250.01
2009/0126925 A1 * 5/2009 Guest et al. ..... 166/118

OTHER PUBLICATIONS

BTU, HPHT Retrievable Packer/Plug; Bronnteknologiutvikling; 2005; 1 page.
MacKenzie, Gordan R.J., et al.; "Hydraulics As It Affects Our Tools—The Inflatable Paradox", SPE 89537, Mar. 2004, 1-7.
Coronado, Martin P., "Development of an Internal Coiled Tubing Connector Utilizing Permanent Packer Technology", SPE 46036, Apr. 1998, 139-148.
Chapman, I.C., et al., "Wireline Deployed Meal Sealing Bridge Plug System: Operational Learning Curve and Subsequent Redevelopment" SPE 113891, Apr. 2008, 1-13.

* cited by examiner

*Primary Examiner*—William P Neuder
(74) *Attorney, Agent, or Firm*—Steve Rosenblatt

(57) ABSTRACT

A packer features spaced apart sealing elements with an extrusion barrier between them. When the packer is set the extrusion barrier is protected from debris in the well. The barrier provides full circumferential extrusion protection using one or more rings made of wedge shaped segments that have a keyway at their edges and are assembled in an alternating manner so as to be able to increase or decrease in diameter when mandrel components are moved toward or away from each other. The segments have an opening through which a mandrel projection extends so as to force the segments into the smaller diameter for removal. Travel stops for the segments in the form of machined flats are provided on the relatively movable mandrel components.

20 Claims, 3 Drawing Sheets

RETRACTABLE DOWNHOLE BACKUP ASSEMBLY FOR CIRCUMFERENTIAL SEAL SUPPORT

FIELD OF THE INVENTION

The field of the invention is downhole backup devices for seals and more particularly devices that are retractable and positioned between seals for protection from well fluids and protection of the surrounding tubular from incremental stress from applied pressure differentials.

BACKGROUND OF THE INVENTION

Packers are used downhole to isolate zones in a wellbore. Many styles of packers are in use depending on the application and well conditions. A common design uses an annularly shaped sealing element that is axially compressed by setting down weight, or a setting tool that holds a mandrel and pushes down on a setting sleeve or a hydraulic mechanism that involves blocking a path through the packer and building pressure on a piston assembly to compress the sealing element. When the sealing element is compressed axially it extends radially into a sealing relationship with the surrounding tubular. To enhance the grip of the extended element there is also an upper and a lower set of slips disposed on opposed sides of the sealing element. The slips generally comprise tapered segments with exterior wickers that bite into the surrounding tubular when ramped out on tapered surfaces during the process of axially compressing the sealing element.

One issue with the compression set sealing elements is extrusion in the uphole or the downhole directions. Frequently, anti-extrusion rings are placed at the opposed ends of the sealing element. They plastically deform when the sealing element is axially compressed and engage the surrounding tubular to create a barrier at opposed ends. The problem with anti-extrusion rings is when the packer is retrieved. The plastically deformed rings retain their deformed shape despite extension of the packer mandrel assembly that allows the sealing element to extend axially and radially retract. In essence, the backup rings can still be in contact with the surrounding tubular after the sealing element has retracted away from the backup rings in a radial and an axial direction. When the packer is pulled out in this condition, the backup rings can swab the well as the packer is removed. Swabbing is the act of reducing pressure by removal of a tool that seals as it is being retrieved. This swabbing can cause formation damage or lead to the well coming in and a potential loss of well control. Also, well fluid above the packer is displaced upward or through a small bypass in the tool. This condition severely limits retrieval speed. Another problem is that the backup rings can get mangled on the trip out of the hole and cause the packer to hang up and in severe cases the packer may have to be milled to remove it.

Traditional designs have slips above and below the sealing element. A problem with this design is that when in service, and exposed to pressure differentials acting on the mandrel with the packer set there is a transfer of the applied pressure differential to the wickers of the uphole slips if the differential pressure is in the uphole direction and on the downhole slips if the pressure differential is in the downhole direction. This arrangement creates added stress on the surrounding tubular from the force increment on the slips created by the applied pressure differential.

There is yet another issue with debris in the well such as sand or gravel settling on top of the anti-extrusion rings, thus making it difficult to extract the packer after release.

Extrusion barriers different from continuous pliable rings that plastically deform have been tried. The idea behind a segmented ring design is the ability to maintain an overlapping relationship of the segments as they are ramped out on a tapered surface. This design is illustrated in U.S. Pat. No. 7,290,603. The problem with this design that used long return springs in the hope of biasing the segments to retract is twofold. The long spring members are exposed and can get damaged during run in. The debris in the well can get on the ramp surface or under the long spring elements and prevent the segments from retracting. This design also transfers load from differential pressure into the slips to increase stress in the surrounding tubing wall.

What is needed is an anti-extrusion system that is protected from well fluid debris after it is set while also minimizing the forces created from pressure differentials while in service from further stressing the surrounding tubular. An improved retraction system for a fully circumferential extrusion barrier is also provided to a barrier shielded from well fluids between seals. The barrier elements can have external wickers and function as slips as well as a barrier. These and other features of the present invention will become more readily apparent to those skilled in the art from a review of the description of the preferred embodiment below along with the associated drawings, while recognizing that the full scope of the invention is to be found in the literal and equivalent scope of the appended claims.

SUMMARY OF THE INVENTION

A packer features spaced apart sealing elements with an extrusion barrier between them. When the packer is set the extrusion barrier is protected from debris in the well. The barrier provides full circumferential extrusion protection using one or more rings made of wedge shaped segments that have a keyway at their edges and are assembled in an alternating manner so as to be able to increase or decrease in diameter when mandrel components are moved toward or away from each other. The segments have an opening through which a mandrel projection extends so as to force the segments into the smaller diameter for removal. Travel stops for the segments in the form of machined flats are provided on the relatively movable mandrel components.

DETAILED DESCRIPTION OF THE PREFERRED EMBODIMENT

Figure 1:
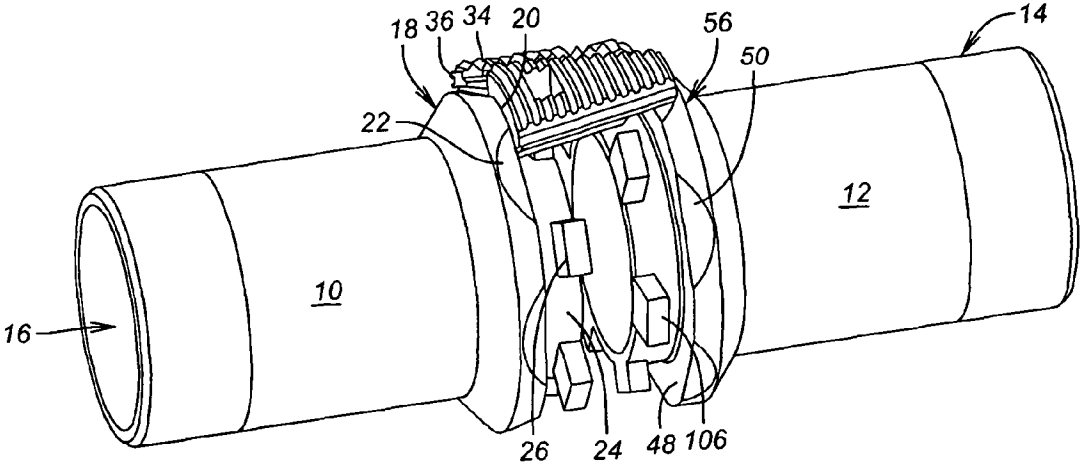
FIG. 1 is a perspective view of mandrel components that move relatively to actuate the segments of the backup system between retracted and extended positions.
Figure 5:
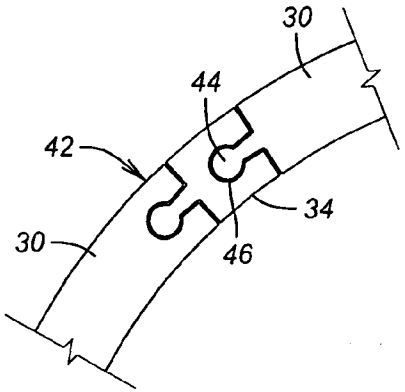
FIG. 5 shows the edge interface between adjacent segments of opposed orientation.

FIG. 1 illustrates the elements of the backup system that can be used downhole in a variety of applications and configurations, as will be explained below. While a given downhole tool will have many other components to accomplish its intended purpose, the basic components of operation of the backup system of the present invention are relatively movable components 10 and 12 that are part of a mandrel assembly 14 with a through passage 16. Component 10 has a fully circumferential exterior ring 18 with a radial pushing segmented surface 20 interrupted by tapered flats 22. A lower hub 24 extends beyond ring 18 and has a plurality of radial projections 26 that are preferably rectangular in cross-section, although other shapes can be used. The spacing on the projections is such that they line up with openings 28 on tapered segments 30 that have their noses 32 pointing in the same direction. Between segments 30 are tapered segments 34 that have their noses 36 pointing in the opposite direction from noses 32. Preferably noses 32 and 36 have a rounded profile so that when the set position is obtained in a packer application seen in FIG. 2 there will not be damage to the sealing elements 38 and 40 that preferably are disposed on opposed sides of the circumferential ring 42 a part of which is shown on an end view in FIG. 5 to show how segments 30 and 34 can be secured on their edges as they slide axially with respect to each other which results in the diameter changing in opposed directions when components 10 and 12 are moved axially with respect to each other. A ball 44 extends into a socket 46 of an adjacent segment edge. Other edge retention devices such as dovetailed L-shapes that permit relative axial sliding on abutting edges while holding the overall ring shape 42 are contemplated to be within the scope of the invention.

Figure 2:
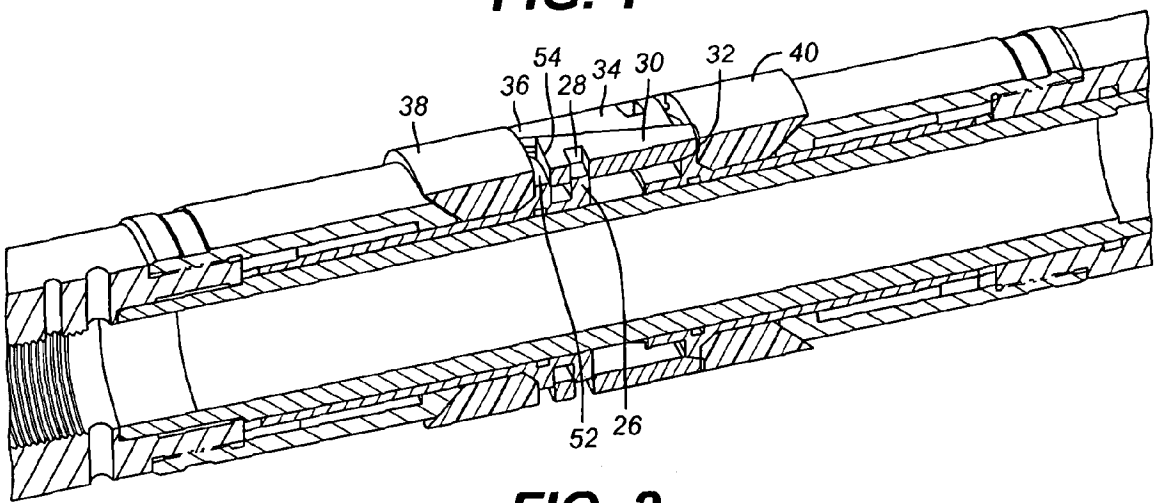
FIG. 2 is a part cutaway view of an application of the backup system of claim 1 to a packer with multiple seals where the backup system is between the seals.
Figure 3:
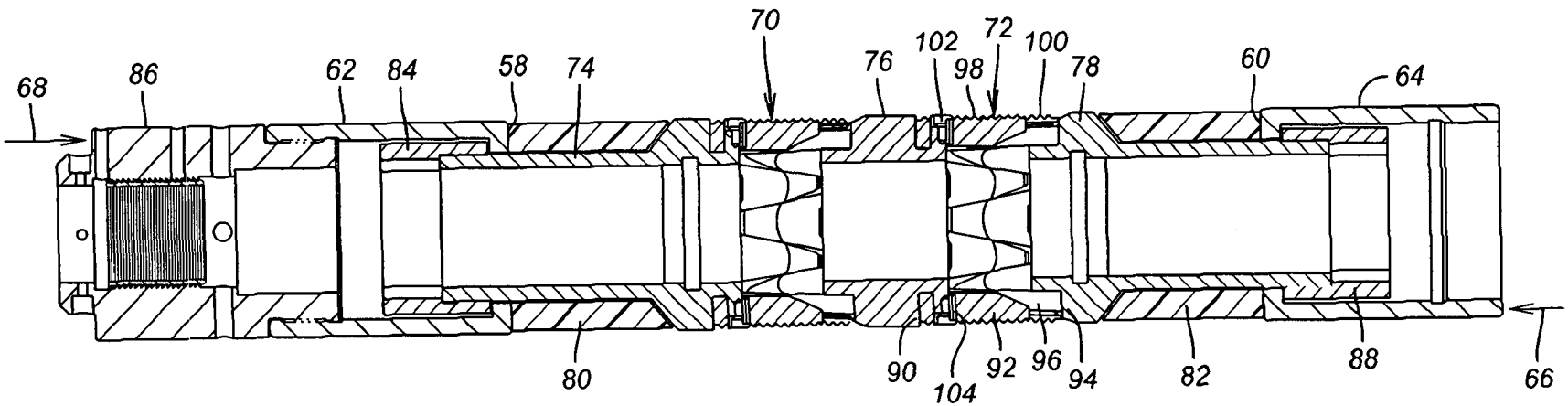
FIG. 3 is an alternative embodiment using two segmented ring backup systems that double as slips shown between seals and in the run in position.
Figure 4:
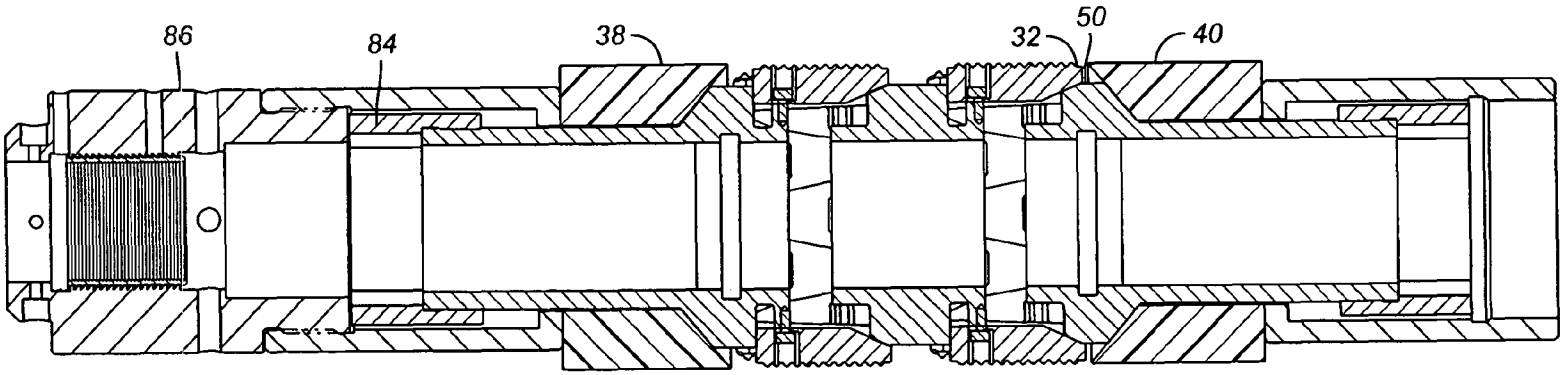
FIG. 4 is the view of FIG. 3 shown in the set position.

Segment 12 is preferably identical to segment 10 and oriented in a mirror image as shown in FIG. 1. Segment 12 has a radial pushing surface 48 to abut segments 34 to push them in the opposite direction as radial surface 20 pushes segments 30 that are oppositely oriented from segments 34. Radial surface 48 is interrupted by tapered flats 50. When components 10 and 12 are pushed together, noses 32 ride over flats 50, as best seen in FIG. 4 showing an alternative embodiment, with a minimal clearance such as about 0.015 inches. Similarly noses 36 ride over flats 22 with a similar clearance. The reason for the minimal clearance is to close off an extrusion route for the seal such as 40 in the set position. As best seen in FIG. 2, there is a series of axial gaps 52 between the tops 54 of segments 30 and the adjacent seal 38 interspersed with noses 36 and the same pattern exists at the opposite end between noses 32 and seal 40. However, axially between noses and an adjacent seal there is no place for extrusion as the tops such as 54 of the opposite oriented segment that is between the noses closes off any extrusion gaps by abutting against ring 18 on one side or ring 56 on the other. The noses 32 or 36 overly the flats 50 and 22 respectively in the set position against a surrounding tubular (not shown) with minimal clearance so that extrusion gaps for seals 38 or 40 are also effectively non-existent being so small. As a result full 360 degree extrusion protection is obtainable in the set position of FIG. 2 for the ends of the seals 38 and 40 that face each other. The outside ends 58 and 60 better seen in FIG. 3 abut sleeves 62 and 64 that are brought closer to each other when acted on by a setting tool shown schematically as arrows 66 and 68. Those skilled in the art will appreciate that other parts have been left out for clarity such as body lock rings to hold a set position after the setting tool 66, 68 sets and automatically releases. To prevent extrusion past ends 58 and 60 when setting, there is a limit to the amount of axial movement of sleeve 62 with respect to sleeve 64. The embodiment shown in FIGS. 3 and 4 illustrates the modular nature of the backup system and uses two rings with opposed segments 70 and 72. It has three spaced mandrel components as opposed to the two components 10 and 12 shown in FIG. 2 when only one backup ring is used. Instead, in FIG. 3 there are mandrel components 74, 76 and 78 that are spaced apart and relatively movable with respect to each other in response to operation of the setting tool 66, 68 for setting and in the opposite direction for removal with a known removal tool that extends the components away from each other. Seal 80 sits on component 74 and seal 82 sits on component 78. Ring 70 is between components 74 and 76 and ring 72 is between components 76 and 78. One travel stop is affected when sleeve 84 contacts top sub 86 as seen by comparing FIGS. 3 and 4. At the other end sleeve 88 runs into an unseen component to act as a second travel stop. As in the FIGS. 1 and 2 embodiment the operation of an individual ring 70 or 72 is the same. For example, for setting, shoulders 90 and 94 respectively push oppositely oriented segments 92 and 96 toward each other. Segments 92 and 96 can also optionally serve as slips if they have wickers 98 and 100 on their respective external faces. For release, components 76 and 78 are pulled apart by a release tool (not shown) which results in radially extending tabs 102 in openings 104 in segments 92 pulling on those segments to move segments 92 with respect to oppositely oriented segments 96 so that the diameter of the ring 72 is positively pulled down to a smaller dimension so that removal from a surrounding tubular (not shown) is made possible. Those skilled in the art will see that the rings 72 and 70 work on the same principle and that the system is modular and can accommodate as many rings as desired. Wickers on the exterior face of any ring are an option for doing double duty as slips. Even within a given ring some components can have wickers while others do not. Note that in the FIG. 1 embodiment where a single ring of segments 30 and 34 are used, both segments 30 and 34 have openings for radially extending members 26 or 106 so that the segments can be pulled apart for release. In the modular design of FIGS. 3 and 4 only segments 92 in ring 72 are shown with radially extending members through openings to exert a force for release but the invention contemplates that all wedge shaped segments that make up a ring can have the openings through which the oppositely oriented segments are pulled to the lower diameter for removal.

Those skilled in the art will appreciate that the preferred location of the backup assembly that can also function as a slip assembly is between sealing elements. When done in that manner, any added force from well pressures does not add to the stress on the surrounding tubular at the location where it is gripped by the wickers on the ring components. The preferred design provides a positive applied force to the opposed segments through an opening in the segments to move them relatively to each other to the smaller diameter position. The use of angled flats toward which the segment noses move creates a very small clearance adjacent a sealing element that is located between the flat ends of the oppositely oriented segments that sit against a radial surface. As a result, going around for 360 degrees, there is either no place for the seal material to be extruded or there is an array of segment noses with undercuts that run parallel to a tapered flat on the mandrel portion to present a very small clearance that has the effect of retaining the seal material against extrusion. The nose are made or machined to a rounded shape so that even if they abut the end of a sealing element, there will not be damage or any tearing of the sealing element.

While the preferred placement of the backup assembly is between sealing elements other arrangements can be used such as putting the backup assembly on one or both ends of a sealing element and in a position of exposure to well pressures and fluids. The segments in the ring or rings that make up the backup assembly used in these locations can also be equipped with wickers and perform a double duty as a backup assembly providing circumferential anti-extrusion protection for an adjacent sealing element as well as an anchor for that tool. Other tools that need a backup or protection from extrusion of components when subjected to well pressure when set are also contemplated to be within the scope of the invention.

The above description is illustrative of the preferred embodiment and many modifications may be made by those skilled in the art without departing from the invention whose scope is to be determined from the literal and equivalent scope of the claims below:

We claim:

1. A backup assembly for a seal on a downhole tool in a wellbore defined by a wall, comprising:

at least a first and second relatively movable mandrel components;

at least one seal mounted on at least one mandrel component;

a plurality of connected wedge shaped segments mounted to said mandrel components and having a wide end and a nose at an opposite end arranged into at least one ring shape and electively relatively movable to change the diameter of said ring with radial growth toward the wall;

said segments reducing at least one gap with respect to the surrounding wall when actuated toward a larger diameter as said ring shape abuts said seal to reduce a tendency of said seal to extrude.

2. The assembly of claim 1, wherein:

said wedge shaped segments are in an alternating arrangement where the nose of one segment on a side of said ring is between the wide ends of segments disposed on either side of it.

3. The assembly of claim 2, wherein:

said wide ends of said segments on one side of said ring are axially moved with respect to the wide ends of segments on an opposite side of said ring.

4. The assembly of claim 3, wherein:

said first and second mandrel components further respectively comprise a first and a second pushing surface in contact with adjacent wide portions of said segments disposed between said pushing surfaces.

5. The assembly of claim 4, wherein:

said pushing surfaces bring said wide ends of said oppositely arranged segments closer to each other to increase the diameter of said ring.

6. The assembly of claim 5, wherein:

when the ring diameter is enlarged, each said pushing surface brings the noses of segments whose wide end it pushes on closer to the other pushing surface.

7. The assembly of claim 1, wherein:

at least some of said segments have an external surface treatment to enhance grip on the wellbore.

8. A backup assembly for a seal on a downhole tool in a wellbore, comprising:

at least a first and second relatively movable mandrel components;

at least one seal mounted on at least one mandrel component;

a plurality of connected wedge shaped segments mounted to said mandrel components and having a wide end and a nose at an opposite end arranged into at least one ring shape and selectively relatively movable to change the diameter of said ring;

said segments reducing at least one gap with said mandrel components when actuated toward a larger diameter;

said wedge shaped segments are in an alternating arrangement where the nose of one segment on a side of said ring is between the wide ends of segments disposed on either side of it;

said wide ends of said segments on one side of said ring are axially moved with respect to the wide ends of segments on an opposite side of said ring;

said first and second mandrel components further respectively comprise a first and a second pushing surface in contact with adjacent wide portions of said segments disposed between said pushing surfaces;

said pushing surfaces bring said wide ends of said oppositely arranged segments closer to each other to increase the diameter of said ring;

when the ring diameter is enlarged, each said pushing surface brings the noses of segments whose wide end it pushes on closer to the other pushing surface;

each pushing surface further comprises a plurality of interruptions toward which the noses of segments whose wide end is pushed by the other pushing surface approach when the diameter of said ring is increased.

9. The assembly of claim 8, wherein:

said interruptions comprise angled flats with an approaching nose having an underside that also has an angled flat so as to reduce the clearance between said flats as said ring diameter is increased.

10. The assembly of claim 9, wherein:

said mandrel components are movable to create a clearance between said angled flats of less than 0.015 inches at or before engaging a travel stop for said mandrel components.

11. The assembly of claim 9, wherein:

at least one mandrel component has extending members that extend into a respective opening in a wedge segment to move those segments in a direction where ring diameter is reduced.

12. The assembly of claim 11, wherein:

said at least one seal on at least one mandrel component comprises a seal on each mandrel component with said segments in between a pair of seals.

13. The assembly of claim 12, wherein:

at least some of said segments have an external surface treatment to enhance grip on the wellbore.

14. The assembly of claim 13, wherein:

said seals are actuated against the wellbore as said ring diameter is increased to contact the wellbore thereby isolating a zone between said seals, where said segments contact the wellbore, from enhanced stress created by wellbore pressure.

15. A backup assembly for a seal on a downhole tool in a wellbore, comprising:

at least a first and second relatively movable mandrel components;

at least one seal mounted on at least one mandrel component;

a plurality of connected wedge shaped segments mounted to said mandrel components and having a wide end and a nose at an opposite end arranged into at least one ring shape and selectively relatively movable to change the diameter of said ring;

said segments reducing at least one gap with said mandrel components when actuated toward a larger diameter;

at least one mandrel component has extending members that extend into a respective opening in a wedge segment to move those segments in a direction where ring diameter is reduced.

16. A backup assembly for a seal on a downhole tool in a wellbore, comprising:

at least a first and second relatively movable mandrel components;

at least one seal mounted on at least one mandrel component;

a plurality of connected wedge shaped segments mounted to said mandrel components and having a wide end and a nose at an opposite end arranged into at least one ring shape and selectively relatively movable to change the diameter of said ring;

said segments reducing at least one gap with said mandrel components when actuated toward a larger diameter;

said at least one seal on at least one mandrel component comprises a seal on each mandrel component with said segments in between a pair of seals.

17. The assembly of claim 16, wherein:

said seals are actuated against the wellbore as said ring diameter is increased to contact the wellbore thereby isolating a zone between said seals, where said segments contact the wellbore, from enhanced stress created by wellbore pressure.

18. A backup assembly for a seal on a downhole tool in a wellbore, comprising:

at least a first and second relatively movable mandrel components;

at least one seal mounted on at least one mandrel component;

a plurality of connected wedge shaped segments mounted to said mandrel components and having a wide end and a nose at an opposite end arranged into at least one ring shape and selectively relatively movable to change the diameter of said ring;

said segments reducing at least one gap with said mandrel components when actuated toward a larger diameter;

said wedge shaped segments are in an alternating arrangement where the nose of one segment on a side of said ring is between the wide ends of segments disposed on either side of it;

said wide ends of said segments on one side of said ring are axially moved with respect to the wide ends of segments on an opposite side of said ring;

said first and second mandrel components further respectively comprise a first and a second pushing surface in contact with adjacent wide portions of said segments disposed between said pushing surfaces;

each pushing surface further comprises a plurality of interruptions toward which the noses of segments whose wide end is pushed by the other pushing surface approach when the diameter of said ring is increased.

19. The assembly of claim 18, wherein:

said interruptions comprise angled flats with an approaching nose having an underside that also has an angled flat so as to reduce the clearance between said flats as said ring diameter is increased.

20. The assembly of claim 19, wherein:

said mandrel components are movable to create a clearance between said angled flats of less than 0.015 inches at or before engaging a travel stop for said mandrel components.

* * * * *